United States Patent [19]

Fisher

[11] Patent Number: 4,553,401

[45] Date of Patent: Nov. 19, 1985

[54] REVERSIBLE CYCLE HEATING AND COOLING SYSTEM

[76] Inventor: Ralph H. Fisher, 120F Windsor Castle Dr., Newport News, Va. 23602

[21] Appl. No.: 691,079

[22] Filed: Jan. 14, 1985

Related U.S. Application Data

[63] Continuation-in-part of Ser. No. 542,375, Oct. 17, 1983, Pat. No. 4,493,193, which is a continuation-in-part of Ser. No. 355,123, Mar. 5, 1982, Pat. No. 4,409,796.

[51] Int. Cl.[4] ..... F25B 13/00

[52] U.S. Cl. ..... 62/160; 62/238.6; 62/238.7; 62/324.4; 237/2 B

[58] Field of Search ..... 62/160, 238.6, 238.7, 62/324.4; 237/2 B

[56] References Cited

U.S. PATENT DOCUMENTS

| | | | |
|---|---|---|---|
| 3,563,304 | 2/1971 | McGrath | 62/238.6 X |
| 3,918,268 | 11/1975 | Nussbaum | 62/160 X |
| 4,165,037 | 8/1979 | McCarson | 62/238.6 X |
| 4,173,865 | 11/1979 | Sawyer | 62/160 X |
| 4,191,023 | 3/1980 | Sisk et al. | 62/324.1 X |
| 4,256,475 | 3/1981 | Schafer | 62/238.7 X |
| 4,257,239 | 3/1981 | Portin et al. | 62/238.7 |
| 4,270,518 | 6/1981 | Bourne | 62/238.7 X |
| 4,373,346 | 2/1983 | Hebert et al. | 62/79 |
| 4,373,354 | 2/1983 | Sawyer | 62/238.6 |
| 4,399,664 | 8/1983 | Derosier | 62/238.6 X |

*Primary Examiner*—Lloyd L. King

*Attorney, Agent, or Firm*—Sixbey, Friedman & Leedom

[57] ABSTRACT

A reversible mode heating and cooling system comprises a reversible heat pump unit having a compressor, a reversible valve, an indoor heat exchanger in heat exchange relationship with indoor ambient air a water cooled concentrator, refrigerant expansion means, an outdoor heat exchanger in heat exchange relationship with outdoor ambient air and an auxiliary heat exchanger in heat exchange relationship with a water source for enhancing the capacity and efficiency of the system to transfer heat to the refrigerant during the heating mode at low outdoor ambient temperatures. The concentrator is disposed downstream of the outdoor heat exchanger (condenser) in the cooling mode of operation to cool the refrigerant exiting the heat exchanger for enhancing its ability to absorb heat in the indoor heat exchanger (evaporator). A temperature and/or pressure sensing and flow control subsystem senses system or ambient parameters and operates fluid flow control valves to most efficiently and effectively direct refrigerant and water source flow to the outdoor and/or auxiliary heat exchangers. A frost preventative or defrost system for the auxiliary heat exchange coil deriving its thermal energy from the hot refrigerant in the compressor discharge conduit is also provided.

17 Claims, 3 Drawing Figures

REVERSIBLE CYCLE HEATING AND COOLING SYSTEM

CROSS-REFERENCE TO RELATED APPLICATIONS

This application is a continuation-in-part of U.S. application Ser. No. 542,375, filed Oct. 17, 1983, now U.S. Pat. No. 4,493,193 which is a continuation-in-part of U.S. application Ser. No. 355,123, filed Mar. 5, 1982, now U.S. Pat. No. 4,409,796.

FIELD OF THE INVENTION

The present invention relates to heating and cooling systems and, more particularly, to such systems which include a heat pump unit operatively associated with heat exchange means for improving the thermal transfer efficiency of the systems.

DESCRIPTION OF THE PRIOR ART

A heat pump is essentially a device for pumping an appropriate refrigerant fluid around a closed circuit for the purpose of heating or cooling a generally indoor space. The conventional elements of a heat pump include a compressor, an expansion valve, an indoor heat exchange coil, an outdoor heat exchange coil, a refrigerant fluid, suitable refrigerant piping, and a refrigerant flow reversing valve. The heat pump has two sides—a low pressure side and a high pressure side. This pressure difference is caused by the compressor and expansion valve which also separate the two sides. One heat exchange coil is located on one pressure side while the other heat exchange coil is on the other side. Generally one heat exchange coil is located inside an enclosure to be heated or cooled and the other coil is located outdoors. The reversing valve is used to reverse the direction of the flow of refrigerant through the heat pump which has the effect of reversing the pressure sides. Thus, at one time the inside coil can be on the low pressure side while at another time the outside coil can be on the low pressure side. Heat is absorbed by the refrigerant in the coil on the low pressure side and given up by the refrigerant in the coil on the high pressure side. Thus, a heat pump transfers heat between the indoor and outdoor coil depending on the position of the reversing valve.

When used as a refrigerating or an air conditioning device, the inside heat exchanger is located on the low pressure side and within the space to be cooled. Heat is absorbed by the liquid refrigerant evaporating within the inside heat exchanger and is rejected by the vaporized refrigerant condensing in the outdoor heat exchanger. Thus, during hot weather, heat is moved from indoors to outdoors to cool the enclosure. When used as a heating device, the inside heat exchanger is located on the high pressure side and within the space to be heated. Heat is absorbed by the liquid refrigerant evaporating within the outdoor heat exchanger and is rejected by the vaporized refrigerant condensing in the inside heat exchanger. Thus, during cold weather, heat is moved from outdoors to indoors to warm the enclosure.

The ability of a heat pump system to efficiently heat or cool an enclosure depends upon its ability to transfer heat between the high and low pressure sides of the system. In large part this ability is a function of the ability of the system condenser to remove heat from the refrigerant in the outdoor heat exchanger during the cooling mode of operation and in the indoor heat exchanger during the heating mode. As a practical matter, condensing of the refrigerant is frequently incomplete resulting in a mixed liquid-gas reduced density refrigerant which has a reduced ability, due to the presence of the gas, to absorb heat in the system evaporator (the indoor heat exchanger during the cooling mode and the outdoor heat exchanger during the heating mode). As a theoretical matter improved condensing can be accomplished by increasing the condenser heat exchange surface area or utilizing a water-cooled rather than an air-cooled condenser. However, as a practical matter, both of these solutions are uneconomical in domestic units such as are used for residental heating and cooling. This is due to the increased capital costs associated with larger condensers and with the expense of supplying the large volumes of water required by heater cooled condensers and then disposing of the water in an environmentally acceptable manner. U.S. Pat. No. 4,373,346 discloses that some improvement in thermal transfer can be achieved by providing both a water cooled precooler between the compressor and the condenser and a water cooled subcooler between the condenser and the evaporator for cooling the refrigerant both before and after thermal transfer from the refrigerant to the ambient air in a conventional air cooled condenser. Notwithstanding that such an arrangement provides thermal transfer improvement it also represents both a significant additional capital expense and an additional water supply and disposal expense.

Another noteworthy shortcoming of a conventional heat pump is its inability to transfer sufficient heat from outdoors to indoors to warm the enclosure during very cold weather when outdoor ambient temperatures are very low. As a practical matter, when the outdoor ambient temperature falls below about 35°–45° F. there is a notable reduction in the capacity of the outdoor heat exchange coil to provide satisfactory heating. This is, in large part, due to the decreased heat which can practically be absorbed by the coil at very low outdoor ambient air temperatures. When the outdoor ambient temperature drops and evaporation is accomplished in an outdoor air heat exchanger of fixed geometry, the result is a drop in evaporation temperature and pressure. This causes a substantial reduction in the density of the refrigerant vapor. The compressor, therefore, can circulate only a substantially reduced mass of refrigerant which accounts, in part, for the substantially reduced heating capacity of the system. Moreover, at the reduced refrigerant pressures, there is a marked loss of volumetric efficiency of the compressor both in terms of quantity of heat contributed by the compressor and in relative heat contribution to the refrigerant fluid.

The practical solution to this requirement for additional heat for the indoor space to be heated has been to furnish supplemental heating, usually in the form of relatively expensive electrical resistance heating or, alternatively, fossil fuel heating. However, with decreasing availability of fossil fuels, increasing energy costs and demanding space and health considerations, neither of these solutions is very appealing or practical any longer. Instead, supplemental heat for heating the indoor space is now frequently derived from a third heat exchange coil disposed in heat exchange relationship with a stable temperature heat source, such as ground water or heat storage facilities which are thermally charged from any of a variety of thermal sources, such as solar collectors, electrical resistance heaters operated during off peak, low demand hours or even from the heat pump unit itself operated during periods of relatively high ambient air temperatures. Such an arrangement is illustrated, for example, in U.S. Pat. No. 4,165,037 which discloses an auxiliary heat exchanger operatively associated and in parallel with respect to refrigerant flow with the outdoor heat exchanger of a heat pump unit. During periods of severely low outdoor ambient temperature, when the efficiency and capacity of the outdoor heat exchanger is reduced and impaired, refrigerant flow is diverted to the auxiliary heat exchanger which derives its thermal energy from a water storage source heated by a solar collector unit. A somewhat similar arrangement is disclosed in U.S. Pat. No. 4,256,475 which shows a solar heated water storage unit for supplying water to the coil of an auxiliary water heat exchanger arranged in parallel with the outdoor heat exchanger of a heat pump unit. When the heat pump unit, due to low outdoor ambient temperature, cannot transfer sufficient heat from the outdoor air to warm the space to be heated, water from the storage unit is circulated to the coil of the auxiliary water heat exchanger to carry heat from the solar heated water storage unit to the refrigerant and, eventually, via the indoor heat exchanger, to the space to be heated. Also of interest is U.S. Pat. No. 3,563,304 which discloses an auxiliary heat exchange coil in heat exchange relationship with a pool of water arranged in series with the conventional outdoor coil of a heat pump unit. During the heating mode of heat pump operation a refrigerant first absorbs heat from the outdoor ambient air in the outdoor heat exchange coil and then absorbs heat from the pool of water in the auxiliary heat exchange coil. However, when outdoor ambient air temperature is extremely low and it is desired to remove the conventional outdoor coil from operation, by virtue of the series arrangement refrigerant will still pass through the outdoor coil and heat will be lost therein.

A problem associated with the use of auxiliary or supplemental heat exchange units which transfer the thermal energy of water to the refrigerant in the heating mode is that under conditions of very low outdoor ambient temperature (e.g., less than about 20° C.) insufficient thermal energy is transferred to the refrigerant in the outdoor heat exchange coil. The result, due to the relatively small amount of water flowing in the auxiliary or supplemental heat exchange coil, is that the refrigerant causes the moisture in the air to freeze onto the coils, precluding heat transfer therethrough and necessitating a shut down of the entire system to de-ice the frozen coil, for example by a hot gas defrost cycle.

SUMMARY OF THE INVENTION

It is, therefore, an object of the present invention to provide an extremely simple, practical and efficient heating and cooling system which includes thermally responsive flow control means to optimize system capacity and efficiency during periods of extremely low and extremely high ambient temperature conditions.

It is another object of the invention to provide a heating and cooling system including a heat pump unit wherein the evaporating and/or condensing capacity of the outdoor heat exchange coil thereof is supplemented by an auxiliary heat exchange coil connected in series-parallel therewith.

It is still another object of the invention to provide a heating and cooling system including a heat pump unit wherein the refrigerant flow relationship between the outdoor coil of the heat pump and an auxiliary heat exchange coil utilized in operative association therewith is variable between series and series-parallel by thermally responsive flow control means.

It is yet another object of the invention to provide a heating and cooling system including a heat pump unit wherein thermal transfer in the evaporator is enhanced by increasing the effective density of the refrigerant downstream of the condenser in order to increase the capacity of the refrigerant to absorb heat.

It is a further object of the invention to provide a heating and cooling system including an auxiliary heat exchange coil having a flow of water therethrough during the heating mode of operation for furnishing thermal energy for evaporating the refrigerant, and further including auxiliary coil frost preventative or defrost means for transferring heat from relatively hot refrigerant discharging the compressor to the auxiliary coil.

Other objects and advantages will become apparent from the following description and appended claims considered together with the accompanying drawings.

Briefly stated, in accordance with the aforesaid objects, the present invention provides a reversible mode heating and cooling system comprising a compressor, a reversible valve for selectively providing heating and cooling from the system by flow path selection, an indoor heat exchanger in heat exchange relationship with indoor ambient air for condensing refrigerant during the heating mode and evaporating refrigerant during the cooling mode, refrigerant expansion means for throttling the refrigerant, an outdoor heat exchanger in heat exchange relationship with outdoor ambient air for evaporating refrigerant during the heating mode and condensing refrigerant during the cooling mode and, desirably, an auxiliary heat exchanger in heat exchange relationship with a heat exchange fluid for enhancing the capacity and efficiency of the system to evaporate refrigerant during the heating mode. The auxiliary heat exchanger is desirably arranged for refrigerant flow only therethrough or for simultaneous parallel and series flow of refrigerant through the auxiliary heat exchanger and the outdoor heat exchanger to enhance the heating efficiency of the system at very low outdoor ambient temperatures and the cooling efficiency of the system at very high outdoor ambient temperatures. A temperature and/or pressure sensing and flow control subsystem is operatively associated with the heating and cooling system to sense system or ambient parameters and to operate fluid flow control valves to most efficiently and effectively direct refrigerant flow to the outdoor and/or auxiliary heat exchangers and to provide and control heat transfer fluid flow to the auxiliary heat exchanger when needed. A water-cooled heat exchanger disposed downstream of the condenser, particularly during the cooling mode, enhances the capacity of the refrigerant to absorb heat in the evaporator and, therefore, to cool the enclosure in which the evaporator is situated. Frost preventative and/or defrost means are associated with the auxiliary heat exchanger coil for passing relatively hot compressor discharge refrigerant in heat exchange relationship with the coil or with relatively cool water for providing heated water to the coil.

DESCRIPTION OF THE PREFERRED EMBODIMENTS

Figure 1:
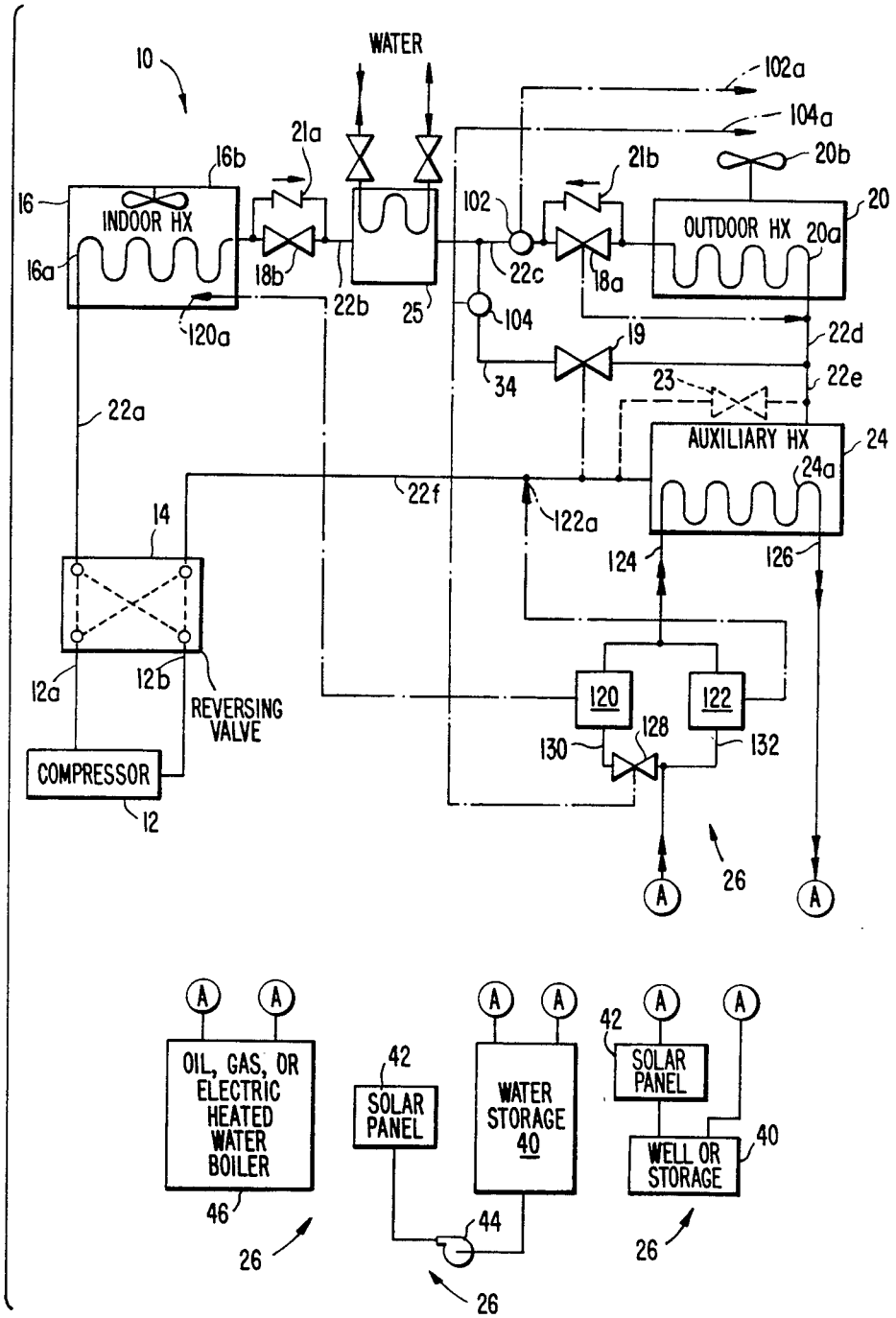
FIG. 1 is a schematic view illustrating a heat pump unit operatively associated with an auxiliary heat exchange unit and provided with a number of exemplary thermal sources and storage facilities therefor.

Referring to the drawings there is illustrated a conventional heat pump system desirably including optional auxiliary heat exchanger means to enhance the heating and cooling efficiency of the system, particularly during the heating mode at very low ambient temperatures and during the cooling mode at very high ambient temperatures. As is well known, a conventional heat pump system may be reversible to switch between the heating and cooling modes. For descriptive simplicity the elements of the present heat pump system will first be described and explained in terms of the heating mode, it being understood that the system may be reversed in conventional manner for the cooling mode.

The basic heat pump system 10 consists essentially of a compressor 12, a reversing valve 14, an indoor heat exchanger 16, a refrigerant concentrator 25, an expansion valve 18*a* and an outdoor heat exchanger 20. Depending upon the position of reversing valve 14, the system is connected to selectively provide heating or cooling. As shown in FIG. 1, reversing valve 14 is in position to provide heating from indoor heat exchanger 16 which is normally located within or in air flow communication with the space to be heated (or cooled). In its essential aspects, indoor heat exchanger 16 includes a heat exchange coil 16*a* and a fan member 16*b*. Heated vaporized refrigerant from compressor 12 passes through compressor discharge conduit 12*a*, reversing valve 14 positioned as shown in dashed lines to provide heating from the system, through refrigerant conduit 22*a* and into and through heat exchange coil 16*a*. The fan member 16*b* blows air over the coil 16*a*, operating as a condenser coil, and heat is absorbed by the air from the heated refrigerant in the coil. The resulting heated air may then be distributed through the space to be heated in a conventional manner, such as via a conventional air duct system.

The heated refrigerant in coil 16*a* is condensed by the flow of air thereover and the resulting condensed refrigerant exiting coil 16*a* is directed through check valve 21*a*, refrigerant conduit 22*b*, water cooled refrigerant concentrator 25, expansion valve 18*a* and refrigerant conduit 22*c* to outdoor heat exchanger 20. The expansion valve 18 throttles the condensed refrigerant to reduce the pressure and the saturation temperature of the liquid in order to enhance evaporative heat transfer to the refrigerant liquid in outdoor heat exchanger 20.

Outdoor heat exchanger 20 is located in heat exchange relationship with the outdoor ambient air and operates to transfer heat from the outdoor ambient air to the liquid refrigerant. For this purpose, outdoor heat exchanger 20 consists essentially of a heat exchange coil 20*a* and a fan member 20*b*. Relatively cool liquid refrigerant passes into and through coil 20*a*, operating as an evaporator coil, and heat is absorbed from the ambient air by the liquid refrigerant as the refrigerant vaporizes. The vaporized refrigerant returns to compressor 12 via refrigerant conduits 22*d*, 22*e*, 23 and 22*f*, reversing valve 14 positioned as shown in dashed lines to provide heating from the system and compressor suction conduit 12*b*. In compressor 12 the vaporized refrigerant is further heated by the work of compression and pump work and the heated vaporized refrigerant is in condition to initiate another cycle of the heating mode for the heat pump system.

The heat pump system hereinbefore described is conventional in all respects except for concentrator 25, as will be described more fully hereinafter, and operates without difficulty to heat the space to be heated as long as the outdoor ambient temperature remains sufficiently high, generally above about 35°–45° F. In such a case enough heat can be transferred to the refrigerant in outdoor heat exchange coil 20*a* that such heat, together with the heat added to the refrigerant in compressor 12, is sufficient, when transferred to the air blown over indoor heat exchange coil 16*a*, to heat the space to be heated. When the outdoor ambient temperature drops below about 35°–45° F., there occurs an observable diminution in available heat for space heating, as has previously been discussed, and a supplemental heat source becomes necessary. In the heat pump system 10 illustrated in FIG. 1, an auxiliary heat exchanger 24 is provided in lieu of or in addition to conduit 23 in series-parallel with outdoor heat exchanger 20 to increase the capacity of the system to absorb heat for vaporizing the refrigerant. Auxiliary heat exchanger 24 consists of a heat exchange means, such as coil 24*a*, through which a heat exchange fluid carrying thermal energy from a source 26 to be described more fully hereinafter, may be circulated via heat exchange fluid feed and discharge lines 124, 126. Liquid refrigerant from conduit 22*c* may be diverted through refrigerant auxiliary bypass conduit 34 and bypass expansion valve 19 to flow through auxiliary heat exchanger 24 in heat exchange relationship with coil 24*a*, wherein the refrigerant absorbs heat and vaporizes, and is then returned to refrigerant conduit 22*f*.

Thermal source 26 for supplying heat to the coil 24*a* of auxiliary heat exchanger 24 may be as simple or sophisticated as energy and natural resource availability and/or environmental conditions allow. Thus, a stable ground water source, such as a well, may be adequate by itself to provide the supplemental thermal requirements of the system. In such a case, relatively warm well water would be drawn via a pump and feed line 124 into coil 24*a* and relatively cool well water would be discharged from coil 24*a* via discharge line 126. In another system, either a well or insulated water storage tank 40 would serve as the heat exchange fluid source and thermal energy would be furnished to the fluid from a solar collector panel 42 mounted in a suitable location for receiving and absorbing solar radiation from the sun. Thus, a pump would pass water from well or storage tank 40 in heat exchange relationship with the solar energy absorbing element of collector panel 42 to absorb heat therefrom and then circulate the heated water via feed line 124 through coil 24*a*. in the coil, heat would be given up to the refrigerant and the resulting relatively cool water would be returned via discharge line 126 to storage tank 40. In a slight variation of this system, water storage tank 40 and solar collector panel 42 are in a separate closed loop which includes circulating pump 44. Pump 44 circulates water from storage tank 40 through solar panel 42 to heat the fluid and then back to storage tank 40 to maintain an adequate supply of relatively warm water at a predetermined suitable temperature available at all times. When auxiliary heat exchanger 24 is placed in service, the relatively warm water is pumped directly from tank 40 and passed through coil 24*e* wherein the water is cooled as the refrigerant is vaporized and the resulting relatively cool water is returned to tank 40 via discharge line 126. Another simple and suitable thermal source 26 for auxiliary heat exchanger 24 is a water boiler unit 46 to which energy is supplied for heating the water therein to a suitable temperature from any variety of conventional energy sources, such as electrical resistance heating, combustion of oil, natural gas or other suitable fuel and the like.

The operation of the system 10 illustrated in FIG. 1 to provide efficient heating utilizing a temperature or pressure sensing and flow control subsystem to direct refrigerant flow to the appropriate heat exchange alternatives will be better understood from the following description. In normal operation of system 10 in the heating mode under conditions wherein outdoor ambient air is above about 35°–45° F., solenoid valve 102 at the inlet to outdoor heat exchanger 20 is open. Solenoid valve 104 in auxiliary bypass conduit 34 is closed and solenoid valve 128 in auxiliary coil heat exchange fluid feed line 124, 130 is also closed. Heated vaporized refrigerant is pumped from compressor 12 via compressor discharge conduit 12*a*, reversing valve 14 and refrigerant conduit 22*a* to indoor heat exchanger coil 16*a* wherein the vaporized refrigerant condenses as it gives up its heat to ambient indoor air blown over coil 16*a* by fan member 16*b*. The heated air is used to heat the space to be heated. The condensed refrigerant passes via check valve 21*a* and conduit 22*b* through concentrator 25, valve 102, expansion valve 18*a* and conduit 22*c* into coil 20*a* of outdoor heat exchanger 20. Ambient outdoor air is blown by fan 20*b* over coil 20*a* to transfer heat from the ambient outdoor air to the liquid refrigerant in coil 20*a*, thereby vaporizing the refrigerant in the coil. The vaporized refrigerant exiting coil 20*a* returns via conduits 22*d*, 22*e*, optional conduit 23 (or to and through auxiliary heat exchanger 24), conduit 22*f* and reversing valve 14 to suction conduit 12*b* of compressor 12. In this manner the space to be heated is adequately heated by the heated air produced in indoor heat exchanger 16. Generally, at temperatures above 35°–45° F. it will not be necessary to operate concentrator 25 to enhance the ability of the refrigerant to absorb heat in outdoor heat exchanger 20 and, therefore, no flow of cooling water through concentrator 25 is required. In such a case, outdoor ambient air temperature sensor 104*a* senses a temperature above a predetermined temperature and valves 104, 128 and the cooling water flow control valve to the concentrator remain de-energized and closed.

Therefore, there is no bypass flow of refrigerant through auxiliary bypass conduit 34 and expansion valve 19 and no flow of heat exchange fluid, such as water, through coil 24*a*. Accordingly, no heat transfer occurs in auxiliary heat exchanger 24. In such an operating condition, inasmuch as valve 128 is closed, it makes little difference whether water source heating mode flow control valve 120 is open or closed. However, under other operating conditions, where valve 128 is open, flow control valve 120 controls the amount of water reaching coil 24*a* and, therefore, the amount of heat transfer to the refrigerant occurring in auxiliary heat exchanger 24. The position of valve 120 is controlled by temperature sensor 120*a* in indoor heat exchanger 16 which senses the temperature of air after it has been heated by coil 16*a*. When the temperature at 120*a* is below a predetermined minimum, valve 120 opens to allow heat transfer to the refrigerant in auxiliary heat exchanger 24 and, responsive to the temperature sensed at 120*a*, opens more or less to maintain the air temperature at 120*a* as close as possible to the predetermined temperature.

As the outdoor ambient temperature drops below about 35°–45° F., the ability of the outdoor heat exchanger 20 to transfer sufficient heat to the refrigerant decreases and the temperature of the vapor exiting coil 20*a* and eventually reaching coil 16*a* likewise decreases. Outdoor ambient air temperature sensor 104*a* senses the outdoor air temperature decrease and, when a temperature below a first predetermined outdoor air temperature value is reached, optionally energizes the cooling water flow control valves in the concentrator 25. This opens and establishes a countercurrent flow of cooling water therethrough to substantially isobarically reduce the temperature of the liquid refrigerant, thereby concentrating or increasing the density thereof for enhancing the heat absorbing capacity of the refrigerant entering the evaporator and substantially reducing the total quantity of refrigerant admitted to the evaporator. The smaller the quantity of refrigerant admitted while maintaining the same BTU/hr capacity, the smaller the compressor can be to accomplish the work required. Thus, use of a concentrator in the manner described will allow a 1 horsepower compressor to attain a tonnage capacity of about 3 tons as contrasted to about 1 ton or less in a conventional system. Use of concentrator 25 in the heating mode enhances thermal energy absorption by the refrigerant in the outdoor heat exchanger 20 and auxiliary heat exchanger 24 and reduces the heat exchange fluid demands on source 26. Sensor 104*a* also energizes solenoid valves 104 and 128 to open to divert a portion of the liquid refrigerant to bypass outdoor heat exchanger 20 by flowing directly through auxiliary heat exchanger 24 and to allow a flow of heat exchange fluid to commence through coil 24*a*. The diverted refrigerant flow passes via auxiliary bypass conduit 34 and conduit 22*e*, through heat exchanger 24 wherein it absorbs heat from the heat exchange fluid flowing in coil 24*a* and vaporizes, and then via conduit 22*f* enroute to compressor 12. Temperature sensor 120*a* in indoor heat exchanger 16 senses the temperature of the air after it has been heated by coil 16*a* and operates flow control valve 120 to control the flow of heat exchange fluid reaching coil 24*a* and, thereby, the amount of heat available for transfer to the refrigerant in heat exchanger 24. In an alternative embodiment, the opening and closing of valves 104 and 128 can be accomplished in response to signals received from temperature sensors (not shown) which sense the temperature of refrigerant entering and leaving coil 20*a*, respectively.

Thus, of the refrigerant flow passing from indoor heat exchanger 16 to the auxiliary heat exchanger 24 a portion flows, via bypass conduit 34, in parallel to the refrigerant flow in outdoor heat exchanger 20 and a portion flows, through conduits 22*d*, 22*e*, in series with the refrigerant flow in outdoor heat exchanger 20. The division of flow along these two paths in the heating mode is generally determined by the relative positions of expansion valves 18*a* and 19, which open and close in response to temperatures (or pressures) sensed downstream of outdoor heat exchanger 20 and auxiliary heat exchanger 24, respectively. As a practical matter the predetermined air temperature at 120*a*, about 105° F., is sufficiently high that the temperature sensed at 120*a* is below the predetermined temperature under virtually all conditions where there is no heat transfer to the refrigerant in auxiliary heat exchanger 24. Therefore, valve 120 is generally open and, with valve 128 energized open, a flow of water is established through valve 120 and heat exchange fluid feed lines 130 and 124 to coil 24*e* at a suitable temperature for transferring heat to the refrigerant passing through auxiliary heat exchanger 24. The water is discharged from coil 24*a* via heat exchange fluid discharge line 126. In this way the heat absorbed by the refrigerant in coil 20*a* is supplemented by the heat absorbed by the refrigerant in heat exchanger 24 with the result that liquid refrigerant from bypass conduit 34 and any unvaporized liquid refrigerant exiting coil 10*a* is vaporized in heat exchanger 24 and/or the temperature of the refrigerant vapor, is increased. The heat added to the refrigerant in auxiliary heat exchanger 24 is seen as increased temperature air sensed at 120*a*. In this way, heating mode control valve 120 adjustably passes just sufficient water for heat transfer purposes to raise the air temperature sensed at 120*a* to some predeterminded value. Thus, as the outdoor ambient temperature rises and falls, the amount of heat transfer occurring in auxiliary heat exchanger 24 correspondingly decreases and increases.

As the outdoor ambient temperature continues to drop, the amount of heat transferred from the outdoor ambient air to the refrigerant in coil 20*a* likewise continues to decrease until, at some point, the capacity of the outdoor heat exchanger 20 to vaporize refrigerant is low enough that no meaningful heat transfer between the ambient air and the liquid refrigerant occurs in outdoor heat exchanger 20. At this point it becomes desirable to completely bypass heat exchanger 20 and divert all refrigerant flow from indoor heat exchanger 16 through auxiliary heat exchanger 24. This can be accomplished by deenergizing and closing solenoid valve 102 in response to a signal from a temperature sensing means which senses a temperature correlatable to the heat exchange capacity of the outdoor heat exchanger, such as outdoor air temperature sensor 102*a* which signals the closing of valve 102 when the outdoor air temperature drops below a second predetermined value.

If, for some reason, an auxiliary thermal source 16 is unavailable or inadequate or it is uneconomical or undesirable to use such a source, and environmental conditions are such that solar heating is both practical and reliable, then the refrigerant in system 10 may be passed in heat exchange relationship with the solar energy absorbing element of an optional solar collector panel (not shown) to absorb heat directly therefrom. In such a case, unevaporated liquid in refrigerant conduit 22*e* is wholly or partially diverted via a solar bypass conduit (not shown) through the solar collector panel, which is suitably located for receiving and absorbing solar radiation. The vaporized refrigerant is then returned via a solar bypass return conduit (not shown) to refrigerant conduit 22*f* which directs refrigerant flow through reversing valve 14 to compressor 12. A temperature sensor (not shown) in the solar bypass return conduit senses vaporized refrigerant temperature and may be used to energize or de-energize a solenoid flow control valve to control refrigerant flow through the panel.

It has been found that the system illustrated in FIG. 1 can be most advantageously operated with simultaneous parallel and series refrigerant flow through heat exchangers 20 and 24. By careful adjustment of the system flow control valves very high efficiency and heat absorption capacity can be realized from the system, even without use of concentrator 25 in the heating mode, by cooling the water passing through auxiliary coil 24*a* to 32′ F. and utilizing a portion of the latent heat of fusion of the water without flow blockage by ice. This efficiency has been demonstrated in a test system configured as shown in FIG. 1 wherein a space to be heated (not shown) having a volume of 16,200 cubic feet was established in air flow communication with indoor heat exchanger 16. Fan member 16*b* blew indoor ambient air at 68° F. over coil 16*a* at a volumetric flow rate of 2200 cubic feet/minute to produce heated air at 103° F. which was circulated to the space to be heated to maintain the temperature therein at 68° F. The outdoor ambient air temperature was measured to be 10° F. At this low temperature, outdoor heat exchanger 20, which was rated at 36,000 BTU/hour at 17° F., could transfer heat from 10° F. ambient air at a maximum rate of 20,000 BTU/hr. Water was furnished to auxiliary heat exchanger coil 24*a* at 62° F. at a flow rate of 3½ gallons/minute and was discharged from coil 24*a* at 32° F. The contribution of compressor heat and motor heat production to the heat absorbed by the refrigerant was estimated to be about 33% of the heat production capacity of the system. Based upon a measured temperature drop of 30° F. through auxiliary heat exchanger coil 24*a* at a water flow rate of 3½ gallons/minute, assuming no use of latent heat of fusion, the heat transfer rate from coil 24*a* to the refrigerant was 50,400 BTU/hr. The heat transfer rate to the refrigerant from the outside heat exchanger 20 at 10° F. ambient temperature was 20,000 BTU/hr. Thus, the total heat transfer rate of system 10 to the refrigerant, including compressor and motor heat contribution, was 93,632 BTU/hr. It was noted that the test space to be heated experienced a temperature rise of 2° F. in 140 seconds, indicating it was receiving heat at the rate of 130,000 BTU/hr. Thus, the 36,368 BTU/hr received by the test space from the refrigerant not accounted for in terms of heat transfer to the refrigerant must have been provided fo the refrigerant in the proportion 33% from the compressor and 67% from the latent heat of fusion of water. On this basis about 24,367 BTU/hr was obtained from the latent heat of fusion of water, indicating heat extraction therefrom at a rate of about 14.5 BTU/hr/pound of water at 32° F.

In the cooling mode of operation of system 10, heated vaporized refrigerant from compressor 12 is passed via compressor discharge conduit 12*a* through reversing valve 14 positioned as shown in dotted lines to provide cooling from the system and refrigerant conduit 22*f* to optional conduit 23 or auxiliary heat exchanger 24. The refrigerant exiting conduit 23 or auxiliary heat exchanger 24 via conduits 22*e* and 22*d* is directed through coil 20*a* wherein the refrigerant transfers its heat to and is condensed by the outdoor ambient air blown over coil 20*a* by fan member 20*b*. The resulting condensed refrigerant is passed through conduit 22*c*, check valve 21*b*, open valve 102, concentrator 25, expansion valve 18*b*, and refrigerant conduit 22*b* to indoor heat exchanger coil 16*a* in which the refrigerant is vaporized as it absorbs heat from the indoor ambient air blown over coil 16*a* by fan member 16*b*. The vaporized refrigerant returns to compressor 12 via refrigerant conduit 22*a*, reversing valve 14 positioned as shown in dotted lines and compressor suction conduit 12*b*. During normal cooling operation, there is no flow of heat exchange fluid through auxiliary heat exchanger coil 24*a*, and, therefore, all heat removal from the refrigerant occurs in coil 20*a* and concentrator 25. However, in cases of extremely high outdoor ambient temperature, where the ability of outdoor heat exchanger 20 to remove heat from the refrigerant is substantially decreased, auxiliary heat exchanger 25 can be utilized to relieve the cooling and condensing load on outdoor heat exchanger 20. In such cases the pressure of the refrigerant vapor sensed by pressure sensor 122*a*, which is correlatable to refrigerant vapor temperature and, therefore, indicative of the heat content of the vapor, exceeds a predetermined value, e.g., about 225 psi, and a signal from sensor 122*a* causes cooling mode control valve 122 to open and allow a flow of cooling water through heat exchange fluid feed line 132, valve 122 and heat transfer fluid feed line 124 to coil 24*a*. The water is discharged from coil 24*a* via heat transfer fluid discharge line 126. With a flow of cooling water established through coil 24*a* at least a portion of the vaporized refrigerant passing through auxiliary heat exchanger 24 is cooled and/or condensed prior to entering coil 20*a* wherein additional heat is removed to completely condense the refrigerant. During normal cooling mode operation, solenoid valve 104 remains closed and there is no flow of refrigerant through auxiliary bypass conduit 34.

It has been found that the concentrator 25 enhances the efficiency and effectiveness of the system in the cooling mode by increasing the effective density of the refrigerant and thereby effectively increases the amount of refrigerant available to do work. This is accomplished by reducing the temperature of the liquid refrigerant exiting the outdoor heat exchanger 20. It has been found that the beneficial effects of locating a refrigerant concentrator downstream of the condenser (outdoor heat exchanger 20) in the cooling mode can be realized by introducing a countercurrent flow of cooling water thereto sufficient to reduce the temperature of the liquid refrigerant while keeping the pressure constant. The increase in cooling capacity using a water-cooled concentrator in the system, as hereinabove described, has been truly remarkable, enhancing the effective air conditioning capacity as much as three-fold.

Figure 2:
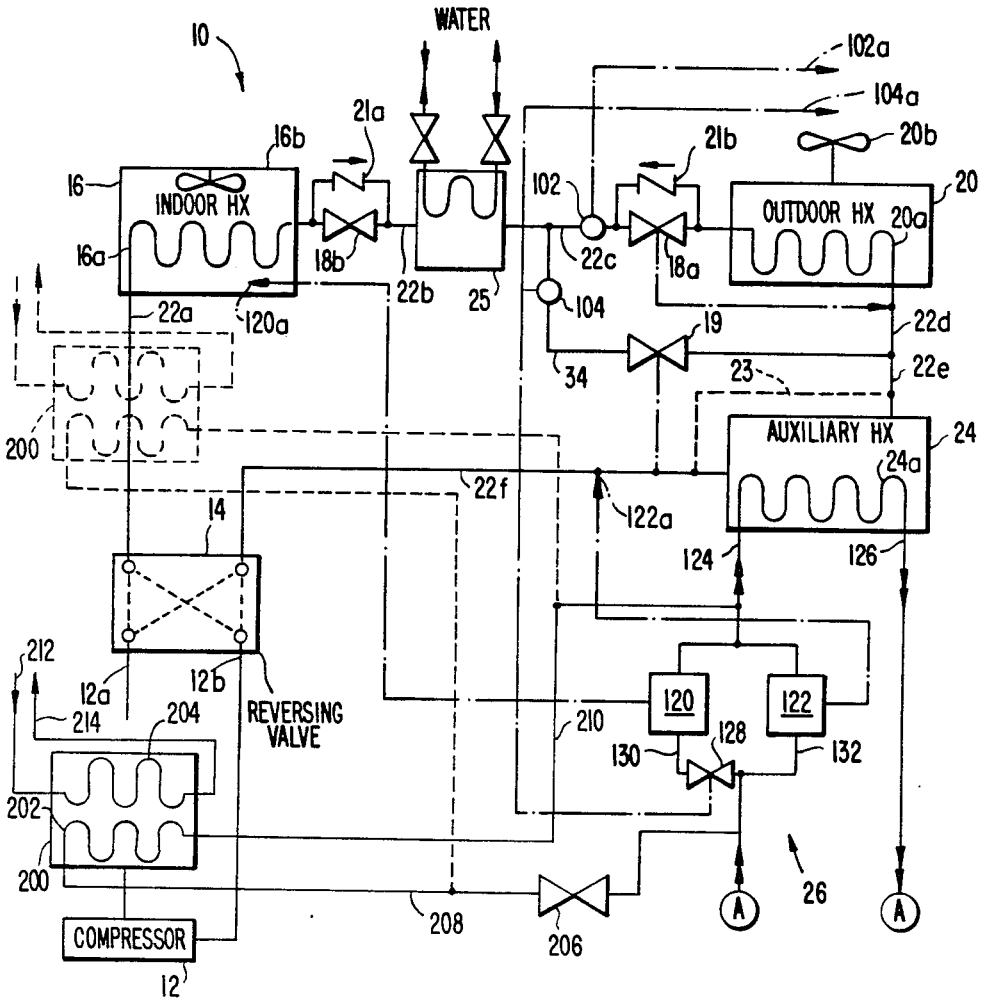
FIG. 2 is a schematic view illustrating a modified form of the heat pump unit shown in FIG. 1.

For example, a heat pump unit configured as shown in FIG. 2 was operated in the cooling mode with refrigerant flow from compressor 12 through reclamation heat exchanger 200, conduit 12*a*, reversing valve 14, conduit 22*f*, auxiliary heat exchanger 24, conduits 22*e* and 22*d*, outdoor heat exchange coil 20*a*, check valve 21*b*, conduit 22*c*, open valve 120, concentrator 25, expansion valve 18*b*, indoor heat exchange coil 16*a*, conduit 22*a*, reversing valve 14 and compressor suction conduit 12*b*. A flow 58° F. cooling water at a rate of 1 gpm was established and maintained through concentrator 25. Cooling water exited concentrator 25 at 78° F. There was no cooling water flow through auxiliary heat exchange coil 24*a* of reclamation heat exchanger coil 204. Therefore, the refrigerant was condensed and cooled in outdoor heat exchange coil 20*a* and concentrator 25 and evaporated in indoor heat exchange coil 16*a* to cool the space to be air conditioned.

Ambient air at 95° F. was blown by fan member 20*b* at a rate of 5800 cfm over outdoor heat exchange coil 20*a* to condense refrigerant therein at a temperature of 108° F. at which temperature the liquid refrigerant flowed into concentrator 25 and was cooled therein to 78° F. The liquid refrigerant was expanded through valve 18*b* and entered indoor heat exchange oil 16*a* at a reduced temperature and pressure. Fan member 16*b* blew air at 5100 cfm from the space to be cooled at a temperature of 86° F. and relative humidity of 54% over coil 16*a* to cool the indoor air to 57° F. In the operation of the compressor and fans of the system at 208 volts, single phase, measurements showed that the compressor drew 30.0 amps, the evaporator fan (16*b*) drew 5.4 amps and the condenser fan (20*b*) drew 1.3 amps for a total load of 36.7 amps and a power consumption of 7634 watts. Operation under these conditions is equivalent to an Energy Efficiency Ration (EER) of about 28. By contrast, the very same system operated without cooling water flow to concentrator 25 cooled the indoor air from 86° F. to 78° F. and drew 45 amps for a total power consumption of 9360 watts, equivalent to an EER of about 6. Thus, it can be seen that concentrator 25 accounted for a 317% improvement in EER. It is particularly noteworthy that by use of concentrator 25 a total cooling capacity of about 15 tons was realized from a conventional five horsepower compressor with standard five-ton-capacity-rated evaporator and condenser.

In the normal operation of heat pump units as shown in FIG. 1 in the heating mode of operation, when the ambient air temperature is very low, (e.g., less than about 20° F.), there is insufficient thermal energy added to the refrigerant in outdoor heat exchanger 20 and insufficient heat exchange flow through auxiliary heat exchange coil 24*a* to prevent periodic icing of auxiliary heat exchange coil 24*a*. The iced coil can be defrosted during the heating mode without need for system shut down or refrigerant flow reversal incident to shifting to a hot gas defrost cycle by modifying the system of FIG. 1 as shown in FIG. 2.

Referring to FIG. 2 there is shown a heat pump system including an auxiliary coil frost preventative or defrost means consisting essentially of a thermal energy reclamation heat exchanger 200 disposed in the refrigerant line between compressor 12 and indoor heat exchanger 16 and including a first heat exchange coil 202 for heating water from the water source and, optionally, a second heat exchange coil 204 for heating domestic water for use in the structure serviced by the heat pump unit. Desirably, heat exchanger 200 is located in compressor discharge conduit 12*a* between compressor 12 and reversing valve 14. Alternatively, as shown in phantom in FIG. 2, heat exchanger 200 can be located in conduit 22*a* between the reversing valve 14 and indoor heat exchanger 16. From the standpoint of defrosting or preventing frost formation on auxiliary heat exchanger coil 24*a*, it is immaterial whether heat exchanger 200 is located in conduit 12*a* or 22*a*. However, from the standpoint of domestic water heating the refrigerant in conduit 12*a* is always hot, whether the heat pump unit is in the heating or air conditioning mode, allowing domestic water heating to take place at any time. By contrast, the refrigerant in conduit 22*a* is only hot enough to heat domestic water during the heating mode of heat pump operation.

The defrost or front preventative capability of the system can be operated harmoniously with normal operation of the system in the heating mode and may either be activated periodically, as by timers, to prevent frost formation or in response to signals from sensors (not shown) which sense, for example, ambient air temperature or refrigerant temperature or pressure in conduit 22*d*, 22*e* or 22*f*. Upon activation of the defrost or frost preventative means with the system in the heating mode of operation a fan limit control in the indoor fan wiring shuts down indoor fan 16*b* to avoid blowing cold air throughout the space being heated. Water source flow control valve 206, which may be a solenoid operated valve, in water source conduit 208 is opened in response to a signal initiated by a timer, temperature or vapor pressure sensor, to permit water source flow through conduit 208, coil 202 and water source conduit 210 into heat exchange fluid feed line 124 and auxiliary coil 24*a*. In heat exchanger 200, source water, at about 55° F., is heated by the relatively hot refrigerant gas exiting compressor 12 to about 65° F. The 65° F. water flowing through auxiliary coil 24*a* rapidly defrosts coil 24*a*. When defrosting is completed, as determined by a timer control or a refrigerant temperature or pressure sensor, valve 206 is closed to terminate water source flow through heat exchanger 200. Indoor fan 16*b* is energized to operate only after the refrigerant gas passing through indoor heat exchanger 16 is hot enough to permit an immediate discharge of warm air into the space to be heated. Domestic water may be heated at any time in heat exchanger 200 by thermal exchange with the hot refrigerant gas passing therethrough by flowing domestic water via domestic water feed and return conduits 212, 214 through coil 204.

In another embodiment of the auxiliary coil frost preventative or defrost means, not shown, all heat exchange fluid flow from the water source to auxiliary coil 24*a* passes through reclamation heat exchanger 200, conduit 208, coil 202 and conduit 210. Both flow control valves 120 and 122 preferably operate in response to signals from pressure sensor 122*a* in conduit 22*f*. Pressure responsive valves are preferred for use because of their commercial availability at reasonable cost. Temperature responsive valves, if available, operating in response to a temperature sensor in conduit 22*f* or elsewhere would function equally well. In accordance with this embodiment source water raised to about 65° F. in reclamation heat exchanger 200 is passed through coil 24*a* to transfer thermal energy to refrigerant in the auxiliary heat exchanger 24. As a result icing of the coil is substantially avoided and the higher temperature water, as compared with normally available 55° F. source water, allows a reduction in flow volume from the water source. As in the FIG. 2 embodiment, heat exchanger 200 is desirably located in compressor discharge conduit 12*a* between compressor 12 and reversing valve 14 in order to allow domestic water heating during both the heating and air conditioning modes of operation. However, heat exchanger 200 can be located in conduit 22*a* if desired. Under conditions of extremely low ambient temperatures it may be desirable to reduce the flow rate of domestic water to allow more thermal energy of the refrigerant gas to reach indoor heat exchanger 16. For this purpose, domestic water feed conduit 212 may include an adjustable flow rate pump therein operated in response to a thermostat in conduit 212 controlling the flow rate of domestic water into heat exchanger 200 via coil 204. The thermostat may be operated in response to signals received from either an ambient air temperature sensor or a domestic water return temperature sensor which senses the temperature of water in domestic water conduit 214. It has been found that a domestic water system heated in this manner can service up to 75% of the hot water needs of an average residence.

Figure 3:
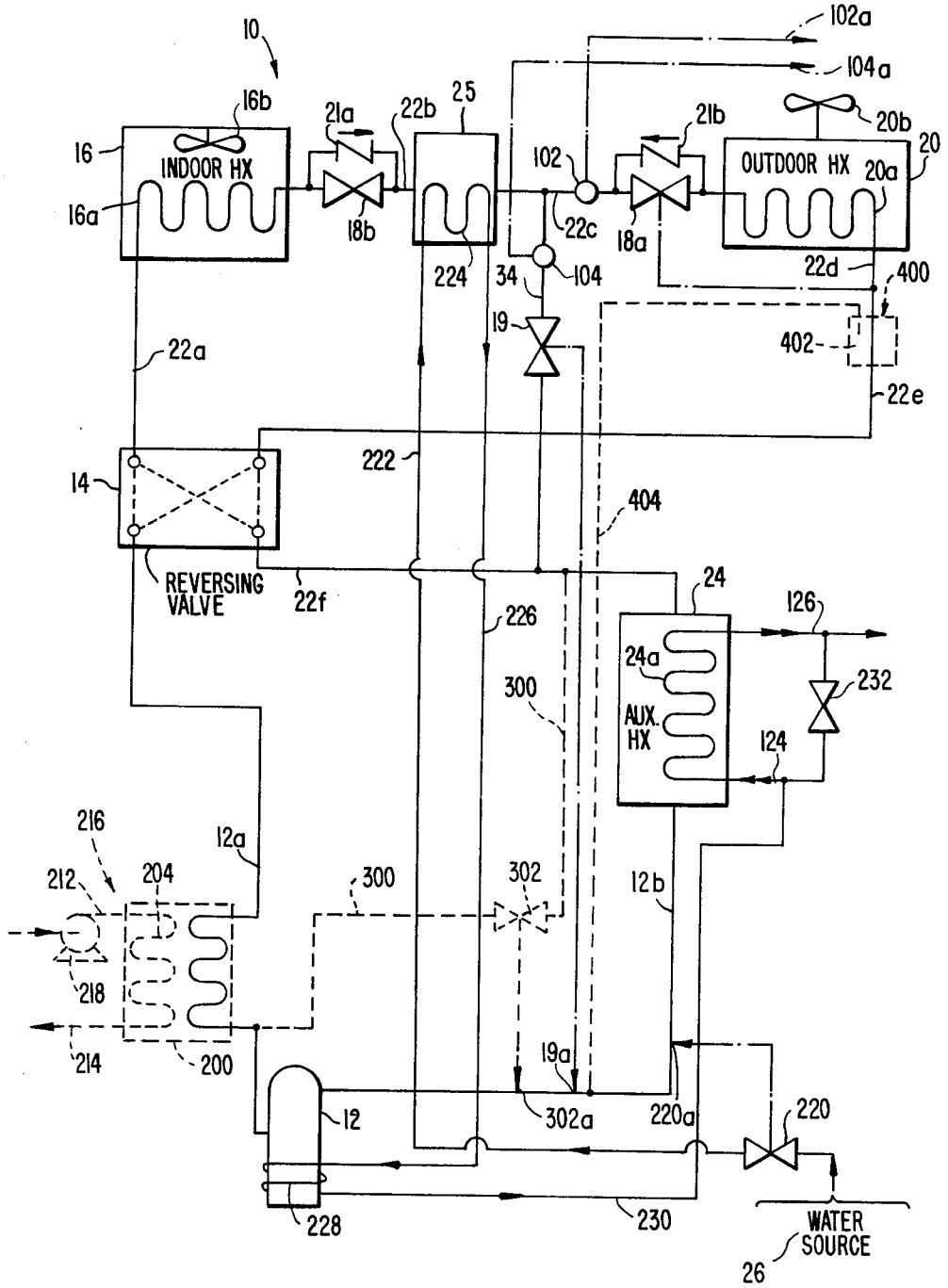
FIG. 3 is a schematic view illustrating another form of the heat pump unit shown in FIG. 2.

A preferred form of the heat pump system of FIGS. 1 and 2 is shown in FIG. 3. The system shown in FIG. 3 arranges concentrator 25 to receive cooling water in a closed loop which includes water source 26, external compressor coils 228 and auxiliary heat exchanger coil 24*a*. The FIG. 3 system also includes a hot refrigerant gas bypass as defrost or frost preventative means for auxiliary coil 24*a* and a liquid trap for allowing the vapor exiting outdoor heat exchanger 20 during the heating mode to bypass the auxiliary heat exchanger 24, thereby reducing the water demand thereto. The following brief description of the operation of the FIG. 3 system in the heating mode will make clear the details of configuration and operation of the system.

In normal operation of the system of FIG. 3 in the heating mode, solenoid valve 102 at the inlet to outdoor heat exchanger 20 is open and solenoid valve 104 in auxiliary bypass conduit 34 is closed. Heated, vaporized refrigerant is pumped from compressor 12 via optional thermal energy reclamation heat exchanger 200 in compressor discharge conduit 12*a*, reversing valve 14 and conduit 22*a* to indoor heat exchange coil 16*a* wherein the vaporized refrigerant condenses as it gives up its heat to indoor ambient air blown over coil 16*a* by fan member 16*b*. The condensed refrigerant passes via conduit 22*b*, check valve 21*a*, concentrator 25, valve 102, expansion valve 18*a* and conduit 22*c* into coil 20*a* of outdoor heat exchanger 20. Ambient outdoor air blown by fan 20*b* over coil 20*a* give up its heat to the liquid refrigerant in coil 20*a* to vaporize the refrigerant in the coil. The refrigerant passes, via conduits 22*d*, 22*e*, 22*f* and reversing valve 14 to and through auxiliary heat exchanger 24 and then returns to compressor 12 via compressor suction conduit 12*b*. Where the outdoor ambient temperature is above about 35° to 45° F. there is no bypass flow of refrigerant through auxiliary bypass conduit 34 and expansion solenoid valve 19 and no flow of heat exchange fluid, such as water, through concentrator 25 or auxiliary heat exchanger coil 24*a*. Accordingly, no heat transfer occurs in either concentrator 25 or auxiliary heat exchanger 24. If desired, a flow of cooling water can be established in coil 204 of domestic water system 216 for heating the domestic water by heat exchange with the hot refrigerant gas in reclamation heat exchanger 200. It has been found that refrigerant flow through the domestic water system with the attendant refrigerant temperature decrease does not adversely affect heating of the air in indoor heat exchanger 16. Rather, it improves system operation by assuring complete refrigerant condensation in the indoor heat exchanger.

Water source flow control valve 220 controls the amount of water reaching concentrator coil 224 and auxiliary heat exchange coil 24*a* and, therefore, the amount of heat transfer from the refrigerant in concentrator 25 and to the refrigerant in auxiliary heat exchanger 24. The position of valve 220 is preferably controlled by pressure sensor 220*a* in conduit 12*b* which senses the vapor pressure of the refrigerant gas therein. The pressure of the refrigerant vapor sensed by pressure sensor 220*a* is correlatable to refrigerant vapor temperature and, therefore, indicative of the heat content of the vapor. When the pressure at 220*a* is below a predetermined minimum, it is indicative that the outdoor heat exchanger 20 is transferring insufficient heat to the refrigerant passing therethrough and a supplemental manner of adding heat to the refrigerant must be implemented. This is accomplished in accordance with the FIG. 3 system by pressure sensor 220*a* signaling valve 220 to open to allow a flow of cooling water to the concentrator 25 and heated water to the auxiliary heat exchanger 24. The source water flow via conduit 222 to concentrator coil 224 further cools the refrigerant liquid exiting indoor heat exchanger 16 at substantially constant pressure to enhance its ability to absorb heat from the ambient air in outdoor heat exchanger 20. The somewhat heated cooling water flows from coil 224 via conduit 226 to coil 228 disposed about and in heat exchange relationship with the base of compressor 12 for absorbing residual or excess waste heat given up by the compressor 12. The source water heated in coil 228 is ducted via conduit 230 to heat transfer fluid feed line 124 for heating the refrigerant passing through auxiliary heat exchanger 24. Responsive to the pressure sensed at 220*a* valve 220 opens more or less to maintain the pressure at 220*a* as close as possible to the predetermined pressure. If desired, the operation of valve 220 can be controlled using a temperature sensor positioned to measure a temperature correlatable with outdoor heat exchanger performance, such as in indoor heat exchanger 16 to sense the temperature of air after it has been heated by coil 16*a*, or by temperature or pressure sensors located at other points in the system.

When the outdoor ambient temperature drops below a predetermined temperature, about 35°–45° F., the ability of the outdoor heat exchanger 20 to transfer sufficient heat to the refrigerant decreases and the pressure sensed at 220*a* likewise decreases. A flow of heat exchange fluid, e.g., water, commences through valve 220, conduit 222, concentrator coil 224, conduit 226, compressor coil 228, conduit 230 and auxiliary coil 24*a* for transferring heat from the refrigerant passing through concentrator 25 and to the refrigerant passing through auxiliary heat exchanger 24. The water is heated enroute to coil 24*a* by the waste heat emanating from compressor 12 to about 65° F., transfers its heat to the refrigerant in auxiliary heat exchanger 24 and is discharged from coil 24*a* via heat exchange fluid discharge line 126. At temperatures below a predetermined value, e.g., 35°–45° F., ambient air temperature sensor 104*a* signals solenoid valve 104 to open and when a temperature below a first predetermined temperature or a pressure below a first predetermined pressure is sensed at sensor 19*a*, solenoid expansion valve 19 is energized to open and a flow of refrigerant is established in auxiliary bypass conduit 34. Thus, of the refrigerant flow passing from indoor heat exchanger 16 to the auxiliary heat exchanger 24 a portion flows, via bypass conduit 34, in parallel to the refrigerant flow in outdoor heat exchanger 20 and a portion flows, through conduits 22*d*, 22*e*, in series with the refrigerant flow in outdoor heat exchanger 20. The division of flow along these two paths is generally determined by the relative positions of expansion valves 18*a* and 19, which open and close in response to temperatures or pressures sensed downstream of outdoor heat exchanger 20 and auxiliary heat exchanger 24, respectively. In this way, the heat absorbed by the refrigerant in coil 20*a* is supplemented by the heat absorbed by the refrigerant in heat exchanger 24 with the result that liquid refrigerant from bypass conduit 34 and any unvaporized liquid refrigerant exiting coil 20*a* are vaporized in heat exchanger 24 and/or the temperature of the refrigerant vapor, is increased. The heat added to the refrigerant in auxiliary heat exchanger 24 is seen as increased vapor pressure refrigerant sensed at 220*a*. In this way, water source control valve 220 adjustably passes just sufficient water for heat transfer purposes to raise the vapor pressure sensed at 220*a* to some predetermined value. Thus, as the outdoor ambient temperature rises and falls, the amount of heat transfer occurring in concentrator 25 and auxiliary heat exchanger 24 correspondingly decreases and increases. In order to minimize the water source demand from the auxiliary heat exchanger 24, a liquid trap 400 may optionally be inserted into conduit 22*d*. When this is done, the vapor portion of the refrigerant exiting outdoor heat exchanger 20 passes into accumulator 402 and then via conduit 404 to conduit 12*b*, thus bypassing the auxiliary heat exchanger 24 completely in order to reduce its heating load. Only the liquid fraction of the refrigerant exiting outdoor heat exchanger 20 continues on via conduits 22*e*, 22*f* and reversing valve 16 to be evaporated in the auxiliary heat exchanger 24.

As the outdoor ambient temperature continues to drop, heat transferred from the outdoor ambient air to the refrigerant in coil 20*a* likewise continues to decrease until, at some point, the capacity of the outdoor heat exchanger 20 to vaporize refrigerant is low enough that no meaningful heat transfer between the ambient air and the liquid refrigerant occurs in outdoor heat exchanger 20. At this point it becomes desirable to completely bypass heat exchanger 20 and divert all refrigerant flow directly from indoor heat exchanger 16 and concentrator 25 through auxiliary heat exchanger 24. This can be accomplished by deenergizing and closing solenoid valve 102 in response to a signal from a temperature sensing means which senses a temperature correlatable to the heat exchange capacity of the outdoor heat exchanger, such as outdoor air temperature sensor 102*a* which signals the closing of valve 102 when the outdoor air temperature drops below a predetermined value.

At very low outdoor ambient temperatures, whether or not there is refrigerant flow through the outdoor heat exchanger 20, it is sometimes necessary to defrost or prevent frost formation on auxiliary heat exchanger coil 24*a*. One way of doing this is to provide a hot gas bypass conduit 300 which diverts a portion of the very hot refrigerant vapor from the compressor discharge conduit 12*a* via bypass control valve 302 to conduit 22*f* upstream of auxiliary heat exchanger 24 to provide a flow of hot refrigerant over coils 24*a*. Flow through bypass conduit 300 may be controlled by pressure or temperature sensor 302*a* sensing the refrigerant vapor pressure or temperature in conduit 12*b*. When the pressure or temperature drops below a predetermined value, indicating inadequate heat transfer in coils 24*a*, sensor 302*a* signals flow control valve 302 to open. Alternatively, of course, flow through conduit 300 can be initiated periodically by timer means.

In the cooling mode of operation of the system of FIG. 3, heated vaporized refrigerant from compressor 12 is passed through heat exchanger 200, via compressor discharge conduit 12*a* through reversing valve 14 and conduits 22*e* and 22*d* to coil 20*a* wherein the refrigerant transfers its heat to and is condensed by the outdoor ambient air blown over coil 20*a* by fan member 20*b*. It is noteworthy that inasmuch as there is no flow of cooling water through auxiliary coil 24*a* in the cooling mode of operation, auxiliary heat exchanger 24 is positioned in the system in such a way that there is no flow of hot refrigerant vapor over coils 24*a* during the cooling mode. This avoids unwanted steam generation from the residual water in coil 24*a* which leads to fouling of coil 24*a* by inorganic minerals deposited from boiling water during such steam generation. The resulting condensed refrigerant is passed through check valve 21*b*, open valve 102, refrigerant conduit 22*c*, concentrator 25, refrigerant conduit 22*b* and expansion valve 18*b* to indoor heat exchanger coil 16*a* in which the refrigerant is vaporized as it absorbs heat from the indoor ambient air blown over coil 16*a* by fan member 16*b*. The vaporized refrigerant returns to compressor 12 via refrigerant conduit 22*a*, reversing valve 14 and compressor suction conduit 12*b*. During normal cooling mode operation, solenoid expansion valve 19 remains closed and there is no flow of refrigerant through auxiliary bypass conduit 34.

In the cooling mode of operation, flow control valve 220 allows a flow of cooling water to coil 224 of concentrator 25 for further cooling the liquid refrigerant exiting outdoor heat exchanger 20. This flow can occur at all times during the cooling mode of operation or can be tied to the ability of the outdoor heat exchanger 20 to remove sufficient heat from the refrigerant to allow adequate cooling mode operation under existing ambient conditions. Thus, if desired, the flow of cooling water to coil 224 of concentrator 25 can be controlled by sensor 220*a* operating flow control valve 220 to initiate the flow of cooling water when the sensor senses a pressure in conduit 12*b* above a predetermined pressure (or temperature). However, inasmuch as during normal cooling mode operation, there is no flow of heat exchange fluid through auxiliary heat exchanger coil 24*a*, the return flow of cooling water via conduit 226, coil 228 and conduit 230 is diverted via source water bypass valve 232 to heat transfer fluid discharge line 126 instead of through coil 24*a*. Of course, in cases of extremely high outdoor ambient temperature, where the ability of outdoor heat exchanger 20 to remove heat from the refrigerant is substantially decreased, reclamation heat exchanger 200 can be utilized to relieve the cooling and condensing load on outdoor heat exchanger 20. In such cases the domestic water system, consisting of pump 218, conduit 212, coil 204 and conduit 214, carries a flow of cooling water into reclamation heat exchanger 200 to cool the refrigerant gas flowing therethrough. It has been found that not only does use of the domestic water system provide useful domestic water but it also assures complete condensation in outdoor heat exchanger 20.

I claim:

1. A reversible mode heating and cooling system for heating and cooling an interior space, comprising:

(a) compressor means for compressing vaporous refrigerant;

(b) indoor heat exchange means arranged in heat exchange relationship with air in said interior space for condensing refrigerant and heating said air during the heating mode and evaporating refrigerant and cooling said air during the cooling mode;

(c) refrigerant expansion means;

(d) outdoor heat exchange means arranged in heat exchange relationship with outdoor ambient air for evaporating refrigerant during the heating mode and condensing refrigerant during the cooling mode;

(e) refrigerant flow reversing means for providing mode means heating and cooling from the system by refrigerant flow direction selection;

(f) water cooled heat exchange means in series flow relationship with and between said outdoor and indoor heat exchangers for cooling liquid refrigerant, said water cooled heat exchange means disposed downstream of said outdoor heat exchanger during the cooling mode and downstream of said indoor heat exchanger during the heating mode;

(g) auxiliary heat exchange means for evaporating refrigerant during the heating mode, said auxiliary heat exchange means arranged in a series flow relationship with said outdoor heat exchange means and downstream thereof during the heating mode;

(h) refrigerant conduit means connecting said compressor means, indoor heat exchange means, water cooled heat exchange means, refrigerant expansion means, outdoor heat exchange means, auxiliary heat exchange means and refrigerant flow reversing means in a series flow relationship to form a reversible heating and cooling system for transferring heat via a fluid refrigerant between said indoor heat exchange means and said outdoor and auxiliary heat exchange means;

(i) bypass refrigerant conduit means connected in a parallel flow relationship with said outdoor heat exchange means and in a series flow relationship with said water cooled and said auxiliary heat exchange means for selectively bypassing said outdoor heat exchange means and directing at least a part of said refrigerant flow from said water cooled heat exchange means through said auxiliary heat exchange means during the heating mode in parallel flow relationship with refrigerant flow through said outdoor heat exchange means;

(j) storage means for storing a heat exchange fluid;

(k) connecting means connecting said storage means and said auxiliary heat exchange means and said storage means and said water cooled heat exchange means for circulating a heat exchange fluid and exchanging heat between said storage means and said auxiliary heat exchange means and said storage means and said water cooled heat exchange means;

(l) first control means for controlling the extent of heat exchange fluid flow from said storage means to said auxiliary heat exchange means, said first control means including a first sensor disposed for sensing a system parameter during the heating mode and first valve means in said connecting means, said first control means including means for adjustably operating said first valve means in said connecting means to allow heat exchange fluid flow therethrough in response to the parameter sensed by said first sensor;

(m) second control means for controlling heat exchange fluid flow from said storage means to said water cooled heat exchange means, said second control means including means for sensing the selected mode, a second sensor disposed for sensing a system parameter during the heating mode and second valve means in said connecting means, said second control means including means for adjustably operating said second valve means in said connecting means to allow heat exchange fluid flow therethrough during the cooling mode and in response to the parameter sensed by said second sensor during the heating mode; and (n) third control means for selectively allowing the flow of refrigerant through said bypass refrigerant conduit means, said third control means including a third sensor disposed for sensing a parameter correlatable to the capacity of said outdoor heat exchanger to add heat to the refrigerant during the heating mode and third valve means in said bypass refrigerant conduit means, said third control means including means for operating said third valve means in said bypass refrigerant conduit means to allow refrigerant flow therethrough in response to the parameter sensed by said third sensor.

2. A system, as claimed in claim 1, including reclamation heat exchange means for transferring heat between refrigerant vapor discharged from said compressor and water flowing through said reclamation heat exchange means.

3. A system, as claimed in claim 2, wherein said reclamation heat exchange means is disposed in said refrigerant conduit means downstream of said compressor and upstream of said indoor heat exchange means during the heating mode of operation.

4. A system, as claimed in claim 2, wherein said reclamation heat exchange means is disposed in said refrigerant conduit means downstream of said compressor and upstream of said refrigerant flow reversing means.

5. A system, as claimed in claim 4, wherein said water comprises said heat exchange fluid from said storage means.

6. A system, as claimed in claim 4, wherein said water is domestic water.

7. A system, as claimed in claim 1, including fourth control means for terminating refrigerant flow through said outdoor heat exchange means when the heat exchange capacity thereof is reduced below a predetermined level.

8. A system, as claimed in claim 7, wherein said fourth control means comprises a fourth sensing means for sensing a parameter correlatable to the heat exchange capacity of said outdoor heat exchange means and inlet flow valve means disposed upstream of said outdoor heat exchange means and downstream of the flow inlet to said bypass refrigerant conduit means during the heating mode, said fourth control means including means for operating said inlet flow valve means to terminate flow therethrough in response to the parameter sensed by said fourth sensing means.

9. A system, as claimed in claim 8, wherein said fourth sensing means comprises a temperature sensor disposed for sensing the temperature of the outdoor ambient air.

10. A system, as claimed in claim 1, wherein said connecting means includes heat exchange fluid conduit means connecting said storage means, water cooled heat exchange means and auxiliary heat exchange means in a series flow relationship to form a continuous flow path for heat exchange fluid for transferring heat from said refrigerant to said heat exchange fluid in said water cooled heat exchange means and from said heat exchange fluid to said refrigerant in said auxiliary heat exchange means.

11. A system, as claimed in claim 10, including compressor heat exchange means in said connecting means for transferring heat from said compressor to said heat exchange fluid, said compressor heat exchange means disposed downstream of said water cooled heat exchange means and upstream of said auxiliary heat exchange means for adding heat to said heat exchange fluid prior to transferring heat therefrom to said refrigerant in said auxiliary heat exchange means.

12. A system, as claimed in claim 11, wherein said compressor heat exchange means comprises a heat exchange fluid conduit arranged in heat exchange relationship with said compressor for transferring waste heat given up by said compressor to fluid in said conduit.

13. A system, as claimed in claim 12, including diverting means in said connecting means for diverting heat exchange fluid exiting said water cooled heat exchange means from said auxiliary heat exchange means during the cooling mode.

14. A system, as claimed in claim 1, including auxiliary heat exchange coil heating means, said coil heating means including refrigerant vapor directing conduit means arranged for directing refrigerant vapor discharged from said compressor to flow over said auxiliary heat exchange coil directing valve means in said directing conduit means and means for operating said directing valve means to allow refrigerant flow therethrough.

15. A system as claimed in claim 14, wherein said means for operating said directing valve means comprises a sensing means for sensing a system parameter correlatable to the heat exchange capacity of said auxiliary heat exchange means, said directing valve means operating in response to the parameter sensed by said sending means.

16. A system, as claimed in claim 1, including liquid trap means disposed downstream of said outdoor heat exchange means, upstream of said auxiliary heat during the heating mode, said liquid trap means comprising an accumulator in series flow relationship with both said outdoor and auxiliary heat exchange means for receiving all refrigerant exiting said outdoor heat exchanger and for passing any liquid portion thereof on to said auxiliary heat exchange means and a vapor conduit communicating with said accumulator and said refrigerant conduit downstream of said auxiliary heat exchange means during the heating mode for bypassing said auxiliary heat exchange means with the vapor portion of said refrigerant.

17. A reversible mode heating and cooling system for heating and cooling an interior space, comprising:

(a) compressor means for compressing vaporous refrigerant;

(b) indoor heat exchange means arranged in heat exchange relationship with air in said interior space for condensing refrigerant and heating said air during the heating mode and evaporating refrigerant and cooling said air during the cooling mode;

(c) refrigerant expansion means;

(d) outdoor heat exchange means arranged in heat exchange relationship with outdoor ambient air for evaporating refrigerant during the heating mode and condensing refrigerant during the cooling mode;

(e) refrigerant flow reversing means for providing mode means heating and cooling from the system by refrigerant flow direction selection;

(f) water cooled heat exchange means in series flow relationship with and between said outdoor and indoor heat exchangers for cooling liquid refrigerant, said water cooled heat exchange means disposed downstream of said outdoor heat exchanger during the cooling mode and downstream of said indoor heat exchanger during the heating mode;

(g) refrigerant conduit means connecting said compressor means, indoor heat exchange means, with water cooled heat exchange means refrigerant expansion means, outdoor heat exchange means and refrigerant flow reversing means in a series flow relationship to form a reversible heating and cooling system for transferring heat via a fluid refrigerant between said indoor heat exchange means and said outdoor exchange means;

(h) storage means for storing a heat exchange fluid;

(i) connecting means connecting said storage means and said water cooled heat exchange means for circulating a heat exchange fluid and exchanging heat between said storage means and said water cooled heat exchange means; and (j) control means for controlling heat exchange fluid flow from said storage means to said water cooled heat exchange means, said control means including means for sensing the selected mode, a sensor disposed for sensing a system parameter during the heating mode and valve means in said connecting means, said control means including means for adjustably operating said valve means in said connecting means to allow heat exchange fluid flow therethrough during the cooling mode and in response to the parameter sensed by said sensor during the heating mode.

* * * * *